US008088454B2

(12) United States Patent
Chen et al.

(10) Patent No.: US 8,088,454 B2
(45) **Date of Patent: *Jan. 3, 2012**

(54) LASER-BASED METHOD FOR MAKING FIELD EMISSION CATHODE

(75) Inventors: Zhuo Chen, Beijing (CN); Chun-Xiang Luo, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 1096 days.

This patent is subject to a terminal disclaimer.

(21) Appl. No.: 11/982,486

(22) Filed: Nov. 2, 2007

(65) Prior Publication Data

US 2008/0220686 A1 Sep. 11, 2008

(30) Foreign Application Priority Data

Dec. 22, 2006 (CN) ..... 2006 1 0157894

(51) Int. Cl.
*B05D 3/00* (2006.01)

(52) U.S. Cl. ..... 427/554; 427/555; 427/586; 427/78; 427/249.1

(58) Field of Classification Search ..... 427/554, 427/586, 555, 77, 78, 249.1; 423/447.3, 423/445 B, 414, 445 R See application file for complete search history.

(56) References Cited

U.S. PATENT DOCUMENTS 2,549,298 A * 4/1951 Donegan ..... 502/434
4,226,900 A * 10/1980 Carlson et al. ..... 427/228
4,682,075 A * 7/1987 Nelson et al. ..... 313/466
4,702,558 A * 10/1987 Coles et al. ..... 349/22
5,154,945 A 10/1992 Baldwin et al.
5,288,558 A * 2/1994 Nothe ..... 428/426
6,444,400 B1 * 9/2002 Cloots et al. ..... 430/311
6,869,479 B2 3/2005 Shafeev et al.
6,917,058 B2 7/2005 Niigaki et al.
7,357,691 B2 4/2008 Liu et al.
7,448,931 B2 11/2008 Liu et al.
7,682,658 B2 3/2010 Jiang et al.
7,771,698 B2 * 8/2010 Chen et al. ..... 423/447.3

(Continued)

FOREIGN PATENT DOCUMENTS

JP 2005-239494 * 8/2005

(Continued)

OTHER PUBLICATIONS

Gutierrez et al. Polymer Photochemistry 7 (1986) 517-521.*

(Continued)

*Primary Examiner* — Bret Chen
(74) *Attorney, Agent, or Firm* — Altis Law Group, Inc.

(57) ABSTRACT

A method for making a field emission cathode includes the steps of: (a) providing a substrate having a first substrate surface and a second substrate surface opposite to the first substrate surface; (b) forming a conductive film on the first substrate surface; (c) forming a light absorption layer on the conductive film; (d) forming a catalyst film on the light absorption layer; (e) flowing a mixture of a carrier gas and a carbon source gas over the catalyst film; (f) focusing a laser beam on the catalyst film and/or on the second substrate surface to locally heat the catalyst to a predetermined reaction temperature; and (g) growing an array of the carbon nanotubes via the catalyst film to form a field emission cathode.

17 Claims, 3 Drawing Sheets

U.S. PATENT DOCUMENTS

| | | | | |
|---|---|---|---|---|
| 7,780,940 | B2 * | 8/2010 | Chen et al. | 423/447.3 |
| 7,820,133 | B2 * | 10/2010 | Chen et al. | 423/447.3 |
| 2001/0003642 | A1 | 6/2001 | Chang et al. | |
| 2001/0010892 | A1 | 8/2001 | Mori | |
| 2002/0061362 | A1 | 5/2002 | Chiavarotti et al. | |
| 2002/0081397 | A1 * | 6/2002 | McGill et al. | 427/596 |
| 2002/0160111 | A1 | 10/2002 | Sun et al. | |
| 2003/0130114 | A1 | 7/2003 | Hampden-Smith et al. | |
| 2004/0060477 | A1 * | 4/2004 | Iwaki et al. | 106/472 |
| 2004/0209385 | A1 | 10/2004 | Liu et al. | |
| 2004/0253758 | A1 * | 12/2004 | Jung et al. | 438/22 |
| 2005/0000438 | A1 | 1/2005 | Lim et al. | |
| 2005/0052127 | A1 | 3/2005 | Sakata et al. | |
| 2005/0113509 | A1 | 5/2005 | Tazzia | |
| 2005/0118525 | A1 | 6/2005 | Kim et al. | |
| 2006/0104890 | A1 | 5/2006 | Harutyunyan et al. | |
| 2006/0147848 | A1 * | 7/2006 | Han et al. | 430/327 |
| 2006/0238095 | A1 | 10/2006 | Nam | |
| 2006/0263524 | A1 | 11/2006 | Jiang et al. | |
| 2008/0233402 | A1 | 9/2008 | Carlson et al. | |
| 2008/0268739 | A1 * | 10/2008 | Chen et al. | 445/50 |

FOREIGN PATENT DOCUMENTS

| | | |
|---|---|---|
| TW | 200634171 | 10/2006 |

OTHER PUBLICATIONS

Kinghong Kwok, Wilson K.S. Chiu. "Growth of carbon nanotubes by open-air laser-induced chemical vapor deposition". Carbon, 2005, vol. 43, p. 437-446.

Composition and Properties of Oil Well Drilling Fluids, 4th Ed., Gray and Darley, Gulf Publishing Company, 1981, p. 9.

* cited by examiner

LASER-BASED METHOD FOR MAKING FIELD EMISSION CATHODE

RELATED APPLICATIONS

This application is related to commonly-assigned applications: U.S. patent application Ser. No. 11/982,674, entitled, "LASER-BASED METHOD FOR MAKING FIELD EMISSION CATHODE", filed Nov. 2, 2007; U.S. patent application Ser. No. 11/982,485, "LASER-BASED METHOD FOR GROWING ARRAY OF CARBON NANOTUBES", filed Nov. 2, 2007; U.S. patent application Ser. No. 11/982,517, "LASER-BASED METHOD FOR GROWING ARRAY OF CARBON NANOTUBES", filed Nov. 2, 2007, which is now patented as U.S. Pat. No. 7,771,698; U.S. patent application Ser. No. 11/982,667, "LASER-BASED METHOD FOR GROWING ARRAY OF CARBON NANOTUBES", filed Nov. 2, 2007; and U.S. patent application Ser. No. 11/982,669, "LASER-BASED METHOD FOR GROWING ARRAY OF CARBON NANOTUBES", filed Nov. 2, 2007, which is now patented as U.S. Pat. No. 7,780,940; and U.S. patent application Ser. No. 11/982,489, "LASER-BASED METHOD FOR GROWING ARRAY OF CARBON NANOTUBES", filed Nov. 2, 2007, which is now patented as U.S. Pat. No. 7,820,113. The disclosures of the above-identified applications are incorporated herein by reference.

BACKGROUND

1. Field of the Invention

The invention relates to methods for making a field emission cathode and, particularly, to a laser-based method for making a carbon nanotube-based field emission cathode.

2. Discussion of Related Art

Carbon nanotubes are a novel carbonaceous material discovered and reported in an article by Sumio Iijima, entitled "Helical Microtubules of Graphitic Carbon" (Nature, Vol. 354, Nov. 7, 1991, pp. 56-58). Carbon nanotubes can transmit an extreme high electrical current and emit electrons at a very low voltage of less than 100 volts, which make it a very promising potential material for field emission applications.

Generally, the carbon nanotubes used for field emission are produced by arc discharge method or chemical vapor deposition method. The method for applying carbon nanotubes in field emission includes the steps of: printing a patterned layer of conductive grease on a conductive base with a predetermined quantity of carbon nanotubes dispersed therein and treating the layer of grease by peeling parts of the grease to expose ends of the carbon nanotubes to emit electrons. However, the step of peeling quite often destroys the carbon nanotubes. Moreover, the carbon nanotubes for emitting electrons generally lie on the conductive base. Thus, the field emission efficiency thereof is relatively low, and the stability thereof is less than desired.

What is needed, therefore, is to provide a laser-based method for making a carbon nanotube-based field emission cathode in which the above problems are eliminated or at least alleviated.

SUMMARY

A method for making a field emission cathode includes the steps of: (a) providing a substrate having a first substrate surface and a second substrate surface opposite to the first substrate surface; (b) forming a conductive film on the first substrate surface; (c) forming a light absorption layer on the conductive film; (d) forming a catalyst film on the light absorption layer; (e) flowing a mixture of a carrier gas and a carbon source gas over the catalyst film; (f) focusing a laser beam on the catalyst film and/or on the second substrate surface to locally heat the catalyst to a predetermined reaction temperature; and (g) growing an array of the carbon nanotubes via the catalyst film to form a field emission cathode.

Other advantages and novel features of the present method for making a field emission cathode will become more apparent from the following detailed description of present embodiments when taken in conjunction with the accompanying drawings.

BRIEF DESCRIPTION OF THE DRAWINGS

Many aspects of the present method for making a field emission cathode can be better understood with reference to the following drawings. The components in the drawings are not necessarily to scale, the emphasis instead being placed upon clearly illustrating the principles of the present laser-based method for making a field emission cathode.

Figure 1:
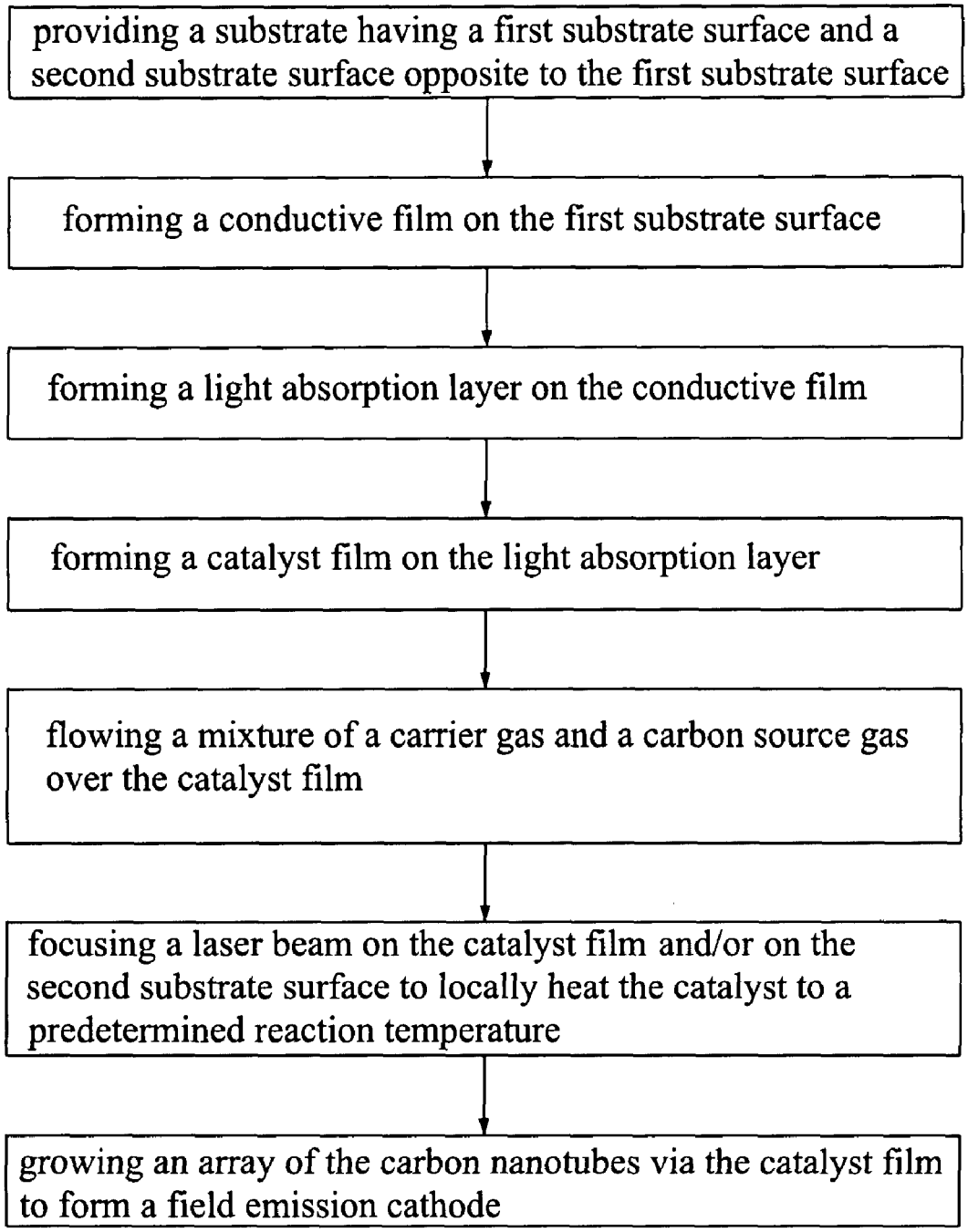
FIG. 1 is a flow chart of a laser-based method for making a field emission cathode, in accordance with a present embodiment.

Corresponding reference characters indicate corresponding parts throughout the several views. The exemplifications set out herein illustrate at least one preferred embodiment of the present laser-based method for making a field emission cathode, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present laser-based method for making a field emission cathode.

Referring to FIG. 1, the laser-based method for making a field emission cathode includes the following steps: (a) providing a substrate having a first substrate surface and a second substrate surface opposite to the first substrate surface; (b) forming a conductive film on (e.g., directly on/in contact with) the first substrate surface; (c) forming a light absorption layer on (e.g., in contact with) the conductive film; (d) forming a catalyst film on (e.g., in contact with) the light absorption layer; (e) flowing a mixture of a carrier gas and a carbon source gas over the catalyst film; (f) focusing at least one laser beam on the catalyst film and/or on the second substrate surface to locally heat the catalyst to a predetermined reaction temperature; and (g) growing an array of the carbon nanotubes via the catalyst film (i.e., the array thereby being indirectly attached to the substrate and extending essentially orthogonally therefrom) to form a field emission cathode.

In step (a), the substrate is, advantageously, made of a heat-resistant material (e.g., high-melting point, chemically durable), which can tolerate the high reaction temperature (e.g., upwards of about 600° C.). It is to be understood that depending on different applications, the material of the substrate could be selected from an opaque or transparent material, e.g., an opaque material such as silicon, silicon dioxide, or a metal for semiconductor electronic devices, or a transparent material such as a glass or plastic material for flat displays.

In step (b), the conductive film usefully is uniformly disposed (e.g., in terms of composition and/or thickness) on the first substrate surface by means of thermal deposition, electron-beam deposition, and/or sputtering. Quite suitably, the conductive film is indium tin oxide film. The width of the conductive film is in the approximate range from 10 to 100 nanometers. Quite suitably, the width of the conductive film is 30 nanometers. It is noted that step (b) is provided as part of the process for making a field emission cathode, since the conductive film is used to conduct electrons and thereby facilitate a connection to an external electrical source. Essentially, the conductive film enables electrons to reach the carbon nanotubes in the grown carbon nanotube array, electrons that can then be emitted by the carbon nanotubes.

Step (c) includes the substeps of: (c1) applying a carbonaceous material layer onto the conductive film on the first substrate surface; (c2) gradually heating the substrate with the carbonaceous material layer within about 60~90 minutes to about 300~450° C. in $N_2$ atmosphere; (c3) baking the substrate with the carbonaceous material for about 15~20 minutes; and (c4) cooling down the substrate with the carbonaceous material to room temperature and forming a light absorption layer on the conductive film.

In step (c1), the carbonaceous material layer can be made of materials having merits of good electrical conductivity, strong adhesion with the substrate, and compatibility with high vacuum environment. Quite usefully, the carbonaceous material is commercial colloidal graphite, as used for CRTs. The carbonaceous material can, beneficially, be spin-coated on the surface of the conductive film at a rotational speed of about 1000~5000 rpm. Quite suitably, the rotational speed for spin coating is about 1500 rpm. In step (c2), the baking process is to eliminate the impurities in the carbonaceous material layer, such as any macromolecular material in the commercial graphite inner coating (GIC). The thickness of the formed light absorption layer is in the approximate range from 1 to 20 micrometers.

In step (d), the catalyst films can be uniformly disposed on the light absorption layer by means of thermal deposition, electron-beam deposition, and/or sputtering. The catalyst can, opportunely, be made of iron, gallium nitride, cobalt, nickel, or any combination alloy thereof. The step (d) can further include forming oxide catalyst particles through such means as high-temperature annealing.

Step (d) includes the substeps of: (d1) providing a catalyst-ethanol solution; (d2) coating the catalyst-ethanol solution on the light absorption layer; and (d3) baking the catalyst solution to form a catalyst film on the light absorption layer.

In step (d1), the catalyst-ethanol solution is formed by combining metallic nitrate compounds with ethanol. The metallic nitrate compounds can be selected from a group consisting of magnesium nitrate (Mg(NO3)2.6H2O), iron nitrate (Fe(NO3)3.9H2O), cobalt nitrate (Co(NO3)2.6H2O), nickel nitrate (Ni(NO3)2.6H2O), and any combination thereof. In one useful embodiment, $Fe(NO_3)_3.9H_2O$ and $Mg(NO_3)_2.6H_2O$ is added to the solution, thereby forming the catalyst solution. Quite usefully, the catalyst solution includes about 0.01~0.5 Mol/L magnesium nitrate and about 0.01~0.5 Mol/L iron nitrate.

In step (d2), the catalyst solution is, beneficially, spin coated on the substrate at a rotational speed of about 1000~5000 rpm. Quite suitably, the rotational speed for spin coating is about 1500 rpm. In step (d3), the substrate with the catalyst solution coated thereon is baked at about 60~100° C. for 10 min~1 hr. It is to be understood that the baking process is used to vaporize the solvent in the solution and accordingly form the catalyst film on the conductive film. The width of the catalyst film is in the approximate range from 10 to 100 micrometers.

In step (e), the carbon source gas acts as a primary source of carbon for growing the carbon nanotubes. In one useful embodiment, the carbon source gas and the carrier gas are directly introduced, in open air, by a nozzle to an area adjacent to the catalyst film. That is, the method can be operated without a closed reactor and/or without being under a vacuum. The carrier gas can, beneficially, be nitrogen ($N_2$) and/or a noble gas. The carbon source gas can, advantageously, be ethylene ($C_2H_4$), methane ($CH_4$), acetylene ($C_2H_2$), ethane ($C_2H_6$), or any combination thereof. Quite suitably, the carrier gas is argon (Ar), and the carbon source gas is acetylene. A ratio of the carrier gas flow-rate to the carbon source gas flow-rate is, opportunely, adjusted to be in an approximate range from 5:1 to 10:1. Quite usefully, the argon flow-rate is 200 sccm (Standard Cubic Centimeter per Minute), and the acetylene flow-rate is 25 sccm.

In step (f), the laser beam can be generated by a laser beam generator (e.g., a carbon dioxide laser, an argon ion laser, etc.). A power of the laser beam generator is in the approximate range from above about 0 W (Watt) (i.e., a measurable amount of power) to ~5 W. Quite usefully, a carbon dioxide laser of 470 mW is used for generating the laser beam. The laser beam generator further includes at least one lens for focusing laser beams generated by the laser beam generator. It is to be understood that the focused laser beam could be employed to irradiate directly on the catalyst film to heat the catalyst to a predetermined reaction temperature along a direction vertical/orthogonal or oblique to the substrate (i.e., the surface of the substrate upon which the array is grown). When the substrate is transparent material, it is to be understood that the focused laser beam could be employed to directly irradiate on the second substrate surface and the substrate could transfer the heat to the catalyst film. The transfer heat would quickly heat the catalyst film to a predetermined reaction temperature along a direction vertical or oblique to the substrate. The heat transfer direction/angle would depend upon such factors as the beam angle relative to the substrate and the crystallography and/or morphology of the substrate. As a result of such various operating parameters, the method can be operated in open air without heating the entire substrate to meet a reaction temperature for synthesizing carbon nanotubes. That is, the operation and cost of the present method is relatively simple and low compared with conventional methods.

In step (f), due to the fact that the focused laser beam is irradiated on the second substrate surface, laser-intensity-induced damage to the newly grown CNTs on the first surface side of the substrate can thereby be effectively avoided. Moreover, the laser beam will not directly react with the carbon source gas nor have an impact on any of the properties of the gas. Thus, the laser beam cannot undermine the growth of carbon nanotubes arrays.

In step (g), due to catalyzing by the catalyst film, the carbon source gas supplied over the catalyst film is pyrolyzed in a gas phase into carbon units (C═C or C) and free hydrogen (H2). The carbon units are absorbed on a free surface of the catalyst film and diffused thereinto. When the catalyst film becomes supersaturated with the dissolved carbon units, carbon nanotube growth is initiated. As the intrusion of the carbon units into the catalyst film continues, an array of carbon nanotubes is formed, extending directly from the catalyst film. The additional hydrogen produced by the pyrolyzed reaction can help reduce the catalyst oxide and thus activate the catalyst. As such, the growth speed of the carbon nanotubes is increased, and the achievable height of the array of the carbon nanotubes is enhanced.

It is noted that the colloidal graphite in the light absorption layer employed in the method has the following virtues. Firstly, the colloidal graphite will absorb laser light and thus facilitate heating of the catalyst to enable carbon nanotube growth. Secondly, the colloidal graphite will attenuate the laser field and avoid damaging the newly grown carbon nanotubes with the otherwise intense laser. Additionally, the colloidal graphite will release carbon atoms to promote the nucleation of carbon nanotubes, when irradiated by a given laser beam. Finally, because of the initial presence of the carbon in the light absorption layer, the supersaturation point for carbon therein will be reached sooner, permitting carbon nanotube growth to start sooner than might otherwise be possible. As such, the predetermined reaction temperature for locally heating the catalyst film by laser beam can be less than ~600° C.

Figure 2:
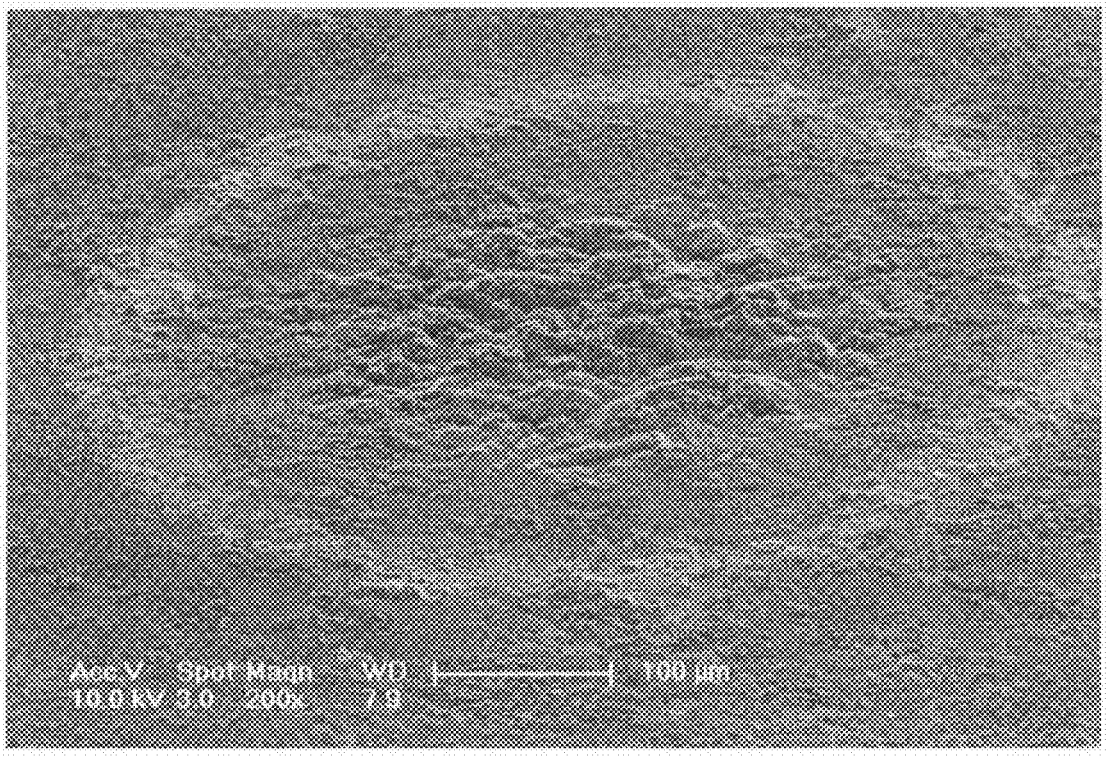
FIG. 2 shows a Scanning Electron Microscope (SEM) image of a carbon nanotube-based field emission cathode formed by the method of FIG. 1.

Referring to FIG. 2, a carbon nanotube-based field emission cathode manufactured by the present method is shown. The carbon nanotube-based field emission cathode is synthesized by irradiating the focused laser beam on the catalyst film formed on a glass substrate for about 5 seconds. A diameter of the focused laser beam is in the approximate range from 50 to 200 micrometers. The field emission cathode includes a substrate, a conductive film serving as an electrode film and an array of carbon nanotubes serving as emitters. The formed array of carbon nanotube, in this example, manifests a hill-shaped. The diameter of the hill is in the approximate range from 50 to 80 micrometers. The maximum height of the hill is in the approximate range from 10 to 20 micrometers. The diameter of each carbon nanotube is in the approximate range from 40 to 80 nanometers.

Figure 3:
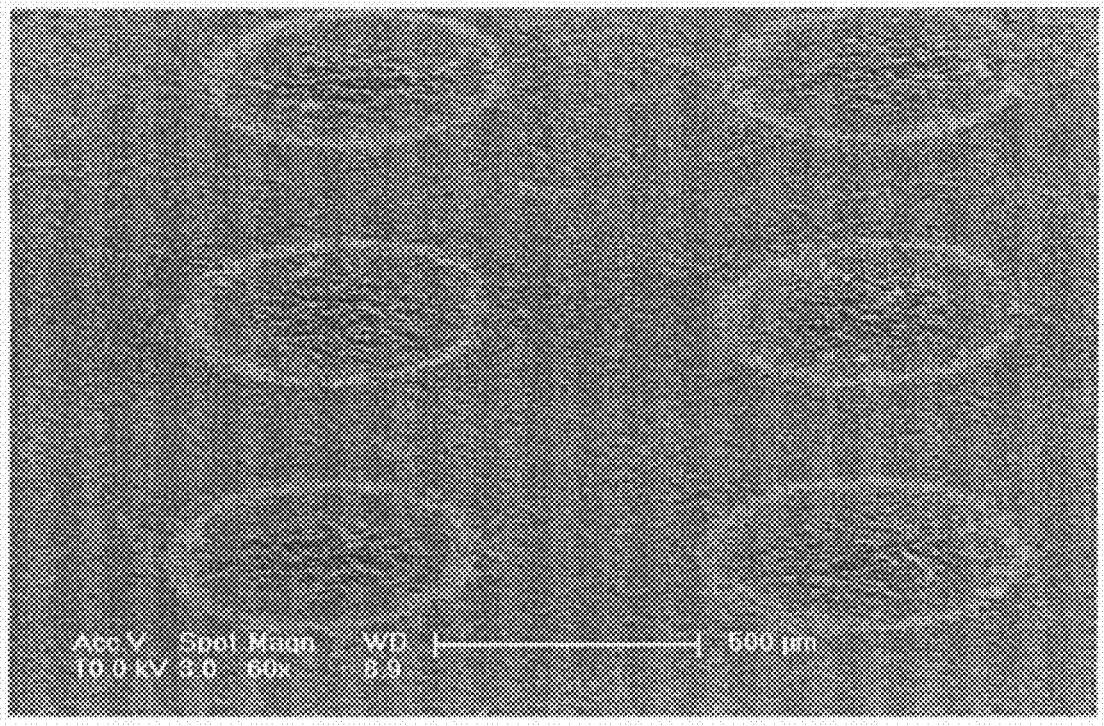
FIG. 3 shows a Scanning Electron Microscope (SEM) image of patterned carbon nanotube-based field emission cathodes formed by the method of FIG. 1.

FIG. 3 shows patterned carbon nanotube-based field emission cathodes manufactured by the present method is shown. The patterned carbon nanotube-based field emission cathodes are synthesized by irradiating a laser beam in a predetermined pattern to selectively heat the catalyst film to the reaction temperature and growing patterned arrays of the carbon nanotubes via/from the catalyst film to form patterned field emission cathodes. The patterned field emission cathodes include a plurality of field emission cathodes arranged in the same substrate to a predetermined pattern. Each field emission cathode includes a carbon nanotube array.

It is noted that, the present method can synthesize a large area array of carbon nanotubes by scanning the laser beam on a large area substrate and that the properties of carbon nanotubes used for field emission cathode thus produced are able to be closely controlled and thereby be essentially uniform.

Compared with conventional arc discharge method or chemical vapor deposition method, the carbon nanotubes used for field emission prepared by the methods in the described embodiments are vertical to the conductive base, which can increase the field emission efficiency and the field emission stability. Furthermore, the colloidal graphite in the light absorption layer employed in the method has the following virtues. Firstly, the colloidal graphite will absorb laser light and thus facilitate heating of the catalyst to enable carbon nanotube growth. Secondly, the colloidal graphite will attenuate the laser field and avoid damaging the newly grown carbon nanotubes with the otherwise intense laser. Additionally, the colloidal graphite will release carbon atoms to promote the nucleation of carbon nanotubes, when irradiated by laser beam. Finally, because of the initial presence of the carbon in the light absorption layer, the supersaturation point for carbon therein will be reached sooner, permitting carbon nanotube growth to start sooner than might otherwise be possible. As such, the predetermined reaction temperature for locally heating the catalyst film by laser beam can be less than ~600° C. What is more, due to the fact that the focused laser beam is irradiated on the second substrate surface, laser-intensity-induced damage to the newly grown CNTs on the first surface side of the substrate can thereby be effectively avoided. Moreover, the laser beam will not directly react with the carbon source gas nor have an impact on any of the properties of the gas. Thus, the laser beam cannot undermine the growth of carbon nanotubes arrays. Moreover, the present method for growing arrays of carbon nanotubes can proceed in open air, without a closed reactor and/or vacuum conditions. Furthermore, the present method can synthesize large area arrays of carbon nanotubes to form a field emission cathode by scanning the laser beam on the catalyst. For all of the various reasons provided, the operation of the present method is relatively simple, and the resultant cost thereof is reasonably low, compared to conventional methods.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for making a field emission cathode, comprising the steps of:

(a) providing a substrate having a first substrate surface and a second substrate surface opposite to the first substrate surface;

(b) forming a conductive film on the first substrate surface;

(c) forming a light absorption layer on the conductive film;

(d) forming a catalyst film on the light absorption layer;

(e) flowing a mixture of a carrier gas and a carbon source gas over the catalyst film;

(f) focusing a laser beam on the second substrate surface to locally heat the catalyst film to a predetermined reaction temperature; and (g) growing an array of the carbon nanotubes via the catalyst film to form a field emission cathode.

2. The method as claimed in claim 1, wherein step (c) further comprises the substeps of:

(c1) applying a carbonaceous material on to the conductive film;

(c2) gradually heating the carbonaceous material to 300° C.-450° C. within 60 minutes-90 minutes in an atmosphere of at least one of $N_2$ and noble gas;

(c3) baking the carbonaceous material; and (c4) cooling down the carbonaceous material to room temperature and forming the light absorption layer on the conductive film.

3. The method as claimed in claim 2, wherein in step (c1), the carbonaceous material comprises colloidal graphite.

4. The method as claimed in claim 3, wherein a layer of the colloidal graphite is formed on the conductive film on the first substrate surface by spin coating.

5. The method as claimed in claim 1, wherein a thickness of the light absorption layer is in the approximate range from 1 to 20 micrometers.

6. The method as claimed in claim 1, wherein step (d) further comprises the substeps of:

(d1) providing a catalyst solution;

(d2) coating the catalyst solution on the light absorption layer; and (d3) baking the catalyst solution to form a catalyst film on the light absorption layer.

7. The method as claimed in claim 6, wherein in step (d1), the catalyst solution soluble comprises metallic nitrate compounds and ethanol.

8. The method as claimed in claim 1, wherein a thickness of the catalyst film is in the approximate range from 1 to 100 nanometers.

9. The method as claimed in claim 1, wherein the conductive film is an indium tin oxide film.

10. The method as claimed in claim 1, wherein a thickness of the conductive film is in the approximate range from 10 to 100 nanometers.

11. The method as claimed in claim 1, wherein the substrate is comprised of a material selected from a group consisting of a glass, and a plastic organic material.

12. The method as claimed in claim 1, wherein a diameter of the focused laser is in the approximate range from 50 to 200 micrometers.

13. A method for making patterned field emission cathodes, comprising the steps of:

(a) forming a conductive layer on a substrate;

(b) applying a light absorption layer onto the conductive layer;

(c) forming a catalyst film on the light absorption layer;

(d) flowing a reactant gas containing carbon source gas over the catalyst film;

(e) irradiating a laser beam in a predetermined pattern to selectively heat the catalyst film to the reaction temperature; and (f) growing patterned arrays of the carbon nanotubes via the catalyst film to form patterned field emission cathodes.

14. The method as claimed in claim 13, wherein the conductive film is an indium tin oxide film.

15. The method as claimed in claim 13, wherein the substrate is made of glass or plastic.

16. The method as claimed in claim 13, wherein step (b) further comprises the substeps of:

(b1) applying a carbonaceous material on to the conductive film;

(b2) gradually heating the carbonaceous material to 300° C.-450° C. within 60 minutes-90 minutes in an atmosphere of at least one of $N_2$ and noble gas;

(b3) baking the carbonaceous material; and (b4) cooling down the carbonaceous material to room temperature and forming the light absorption layer on the light permeable conductive film.

17. The method as claimed in claim 16, wherein in step (b1), the carbonaceous material comprises colloidal graphite.

* * * * *